US005924433A

United States Patent [19]

Thies et al.

[11] Patent Number: 5,924,433

[45] Date of Patent: Jul. 20, 1999

[54] GAS INJECTION PLASTIC MOLDING APPLIED TO A DISHWASHER TUB

[75] Inventors: Edward L. Thies, Niles; Roger J. Bertsch, Stevensville, both of Mich.; John P. Vance, Findlay, Ohio; Roger D. Jewell, St. Joseph, Mich.

[73] Assignee: Whirlpool Corporation, Benton Harbor, Mich.

[21] Appl. No.: 08/820,538

[22] Filed: Mar. 19, 1997

[51] Int. Cl.[6] ..... A47L 15/42

[52] U.S. Cl. ..... 134/200; 134/179; 134/191; 134/201; 312/228

[58] Field of Search ..... 134/175, 176, 134/177, 179, 186, 190, 191, 195, 95.2, 200, 201; 68/3 R; 312/228, 228.1; 220/675, 659; 34/603

[56] References Cited

U.S. PATENT DOCUMENTS

| | | | |
|---|---|---|---|
| 2,563,652 | 8/1951 | LeGore | 134/179 X |
| 2,634,736 | 4/1953 | Bewen | 134/191 X |
| 2,771,895 | 11/1956 | Bond | 134/175 X |
| 2,896,642 | 7/1959 | Lilly | 134/200 X |
| 3,082,779 | 3/1963 | Jacobs . | |
| 3,285,779 | 11/1966 | Dunham | 134/176 X |
| 3,702,680 | 11/1972 | Woehler . | |
| 3,811,746 | 5/1974 | Butsch et al. | 312/228 |
| 3,821,961 | 7/1974 | Schimke | 134/186 X |
| 5,230,553 | 7/1993 | Tuller . | |
| 5,291,758 | 3/1994 | Lee . | |
| 5,531,352 | 7/1996 | Kraft et al. | 220/675 |

*Primary Examiner*—Philip R. Coe
*Attorney, Agent, or Firm*—Hill & Simpson

[57] ABSTRACT

A dishwasher construction having a molded one piece tub with integrally molded reinforcing ribs on an outside surface of the tub, the reinforcing ribs being hollow members formed by gas injection molding. At least one of the reinforcing ribs can be fashioned as a hollow conduit for transferring water from a bottom mounted pump to a top mounted wash arm of the dishwasher, or from a drain pump to a drain outlet. By using hollow reinforcing members molded integrally with the tub, an external upper wash arm conduit is avoided which can have external leakage, and an internal upper wash arm conduit is avoided which tends to restrict the working space within the dishwasher and can trap food and be otherwise functional and unappealing to the consumer.

10 Claims, 4 Drawing Sheets

GAS INJECTION PLASTIC MOLDING APPLIED TO A DISHWASHER TUB

BACKGROUND OF THE INVENTION

The present invention relates to appliance construction in general and in particular to a construction for a dishwasher using gas injection plastic molding techniques.

Gas injection molding techniques are generally known such as described in U.S. Pat. No. 5,401,459. Gas injection molding can generally be described as a process where gas is injected into a plastic mold which holds hot plastic in order to totally fill the mold cavity thereby providing a plastic part that is hollow. For example, if the technique is applied to the creation of a tube, the mold may consist of a cavity that would ordinarily produce a solid bar. The tube is first injected with hot plastic, in an amount less than enough to fill the cavity. This amount is normally referred to as a "short shot." If a solid bar was in fact desired, this short shot would result in an incomplete and defective part. In the case of gas injection molding however, the short shot would be followed with an injection of an inert gas at high pressure. The plastic would have just begun to cool slightly at the outer edges such that the gas will blow the center of the plastic along the mold, causing the mold to fill to the end with a hole through the center of the hollow tube.

A typical dishwasher includes a tub for enclosing the dish containing-and washing area. Conventionally, the tub is made of sheet metal, however a tub of molded plastic material such as polypropylene is disclosed in U.S. Pat. No. 5,230,553. The tub disclosed in this patent is reinforced around an outer circumference thereof with rib like members. For dishwashers which employ an upper spray arm, a water conduit must be provided from the wash water pump to the elevated, upper spray arm. Particularly, many current designs use a short extension directly vertically arranged above the pump which sprays water vertically through the rack area in what is referred to as a "tower." The tower is clearly visible inside the dishwasher and reduces the useful area inside the dishwasher.

It is also possible to fabricate a wash water feed tube from the wash water pump to the upper arm inside the tub. However, although external leaks will be prevented or contained, the inside of the tub becomes somewhat more restricted. These tubes also provide areas where food particles can become trapped and not easily removed from the system. The tube inside the tub also gives the appearance of an unappealing necessity. U.S. Pat. No. 3,082,779 describes a tub assembly made of metal and having on an inside surface thereof a conduit for feeding water to an upper spray tube.

Also, upper arm water feed can be provided with a separate tube passing along the outside of the tub. Connections must be made between the tube and the pump and the upper wash arm, adding labor costs. Also, being outside the tub, the chance of water leaks at the connections and the drawbacks of such water leaks is increased dramatically.

SUMMARY OF THE INVENTION

The present invention provides a dishwasher having a plastic molded surrounding tub having hollow reinforcing ribs which are gas injection molded simultaneously with the molding of the tub. The hollow members are vertical ribs externally located to an interior of the tub and which are vertically arranged on surfaces of walls outside of the tub and which can extend across a top of the tub. The ribs are hollow and can also serve as one or more water conduits for carrying water from the dishwasher pump upwardly to an upper spray arm or arms. The hollow ribs can serve as temporary water storage during operation cycles of the dishwasher.

One or more of the hollow ribs can be utilized as an outlet conduit for a dishwasher drain pump. In some drain systems a minimum water head pressure is required on the drain pump outlet. This water head can be provided by the vertically rising hollow rib serving as drain pump outlet conduit.

The ribs, as hollow members, can also act as insulating members to reduce heat loss from the tub. No additional fastenings or methods are required to adhere separate ribs to the tub walls since the gas injection molded hollow ribs are formed integrally and simultaneously with the tub itself. The gas injection molded reinforcing ribs and integral tub, once formed, is sturdy and reinforced during assembly of the dishwasher, and economical to manufacture.

DETAILED DESCRIPTION OF THE PREFERRED EMBODIMENT

Figure 1:
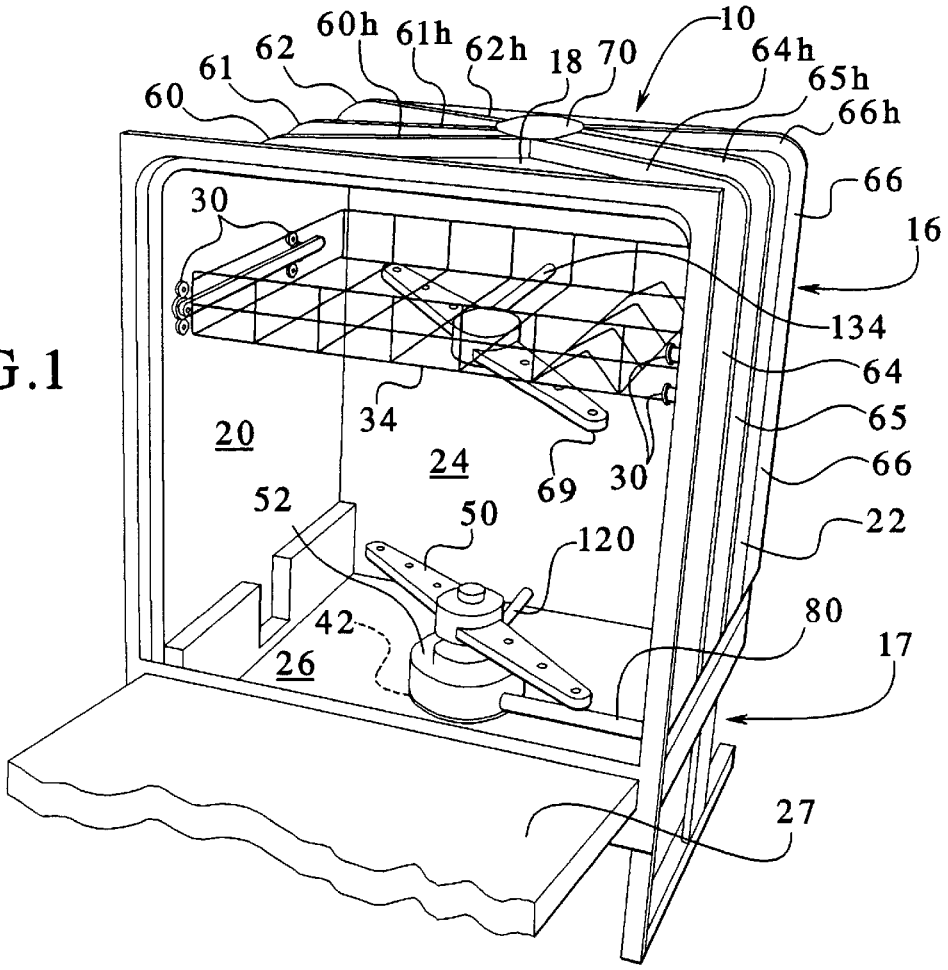
FIG. 1 is a perspective view of a dishwasher of the present invention.

FIG. 1 illustrates a dishwasher utilizing the construction of the present invention. The dishwasher 10 includes a plastic tub 16 supported on a base assembly 17 and having a molded top wall 18, side walls 20, 22, a back wall 24 and a floor 26. The top wall 18, side walls 20, 22, back wall 24 and floor 26 can be molded integrally, or molded separately and fastened together. A pivotable door 27 closes the tub. Held by rollers 30 on the side walls 20, 22 is an upper dish rack 34. A lower dish rack 36 includes rollers 31 which roll on tub offsets or shoulders 37,38 (shown in FIG. 6). Extending upwardly through a central aperture 42 of the floor 26 is a lower spray arm 50 mounted rotationally onto a wash water pump-and-screen assembly 52.

Figure 2:
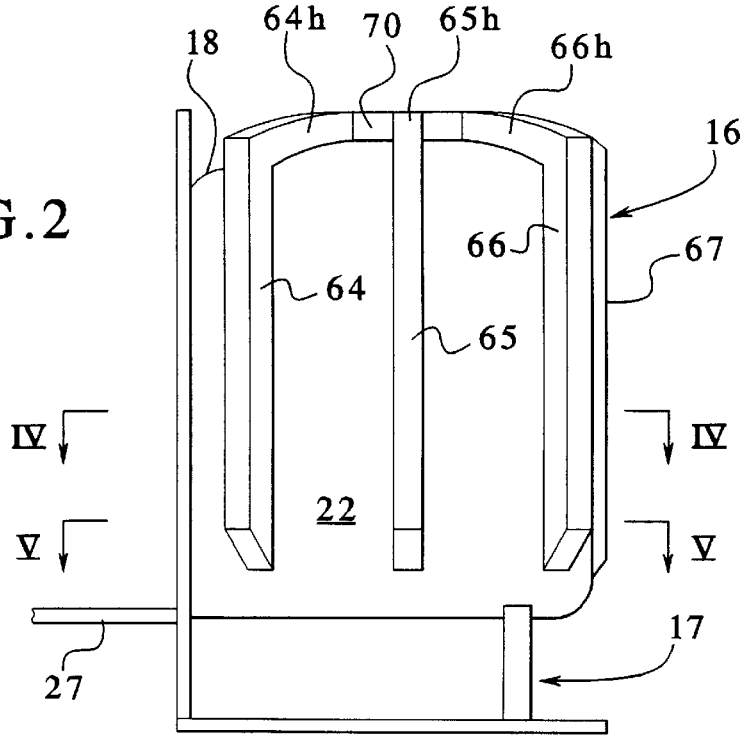
FIG. 2 is a right-side view of the dishwasher shown in FIG. 1.
Figure 3:
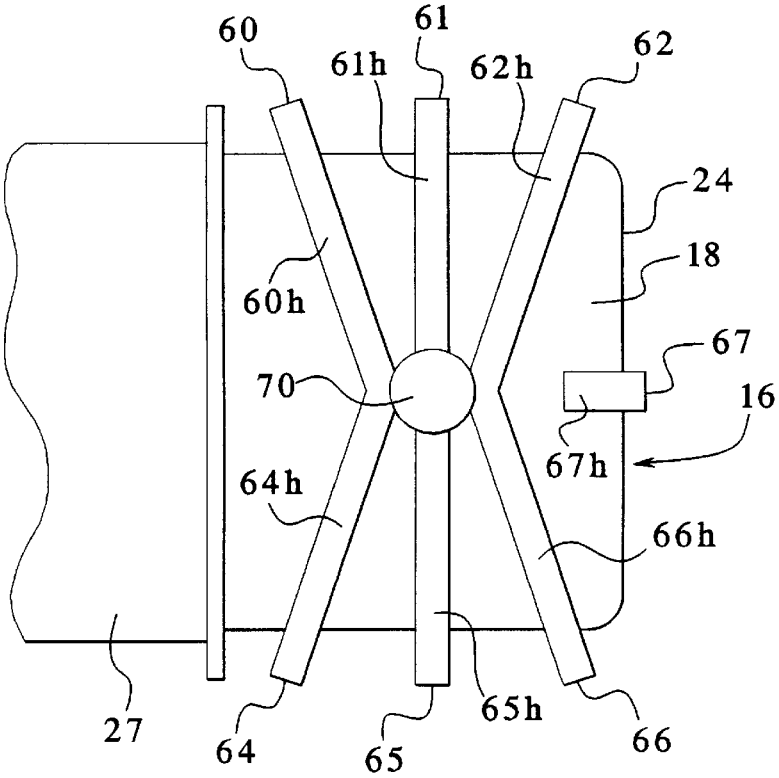
FIG. 3 is a top view of the dishwasher shown in FIG. 1.

As shown in FIGS. 2 and 3, arranged on an outside of each of the side walls 20, 22 are a plurality, in this case three, of vertical ribs 60, 61, 62 and 64, 65, 66 respectively. A vertical rib 67 is arranged on the back wall 24. One or more of the vertical ribs are fashioned as hollow structural members formed by gas injection molding of the side walls 20,22 using a mold having a gas injection nozzle for injecting an inert gas under pressure during the molding of the hollow vertical members integrally with the tub. The hollow vertical members are shown having a generally rectangular cross-section but other cross sections are equally available such as triangular or semi-cylindrical. The vertical ribs 60, 61, 62, 64, 65, 66, 67 all extend across the top wall 18 toward a central hub 70 via horizontal portions 60*h*, 61*h*, 62*h*, 64*h*, 65*h*, 66*h*, 67*h*. The hollow vertical ribs provide sufficient structural reinforcing while minimizing weight and material compared to solid ribs. The ribs are shown having a somewhat exaggerated size for clarity of description.

As one aspect of the invention, at least one or more of the vertical ribs 60, 61, 62, 63, 64, 65, 66 functions as a water conduit for passage of water from the water pump assembly 52 upwardly to a rack mounted top arm 69 for upward spraying and/or through the central hub 70 and to a top mounted wash arm (or "third arm") 72 for spraying downwardly on the dishes within the tub.

Figure 7:
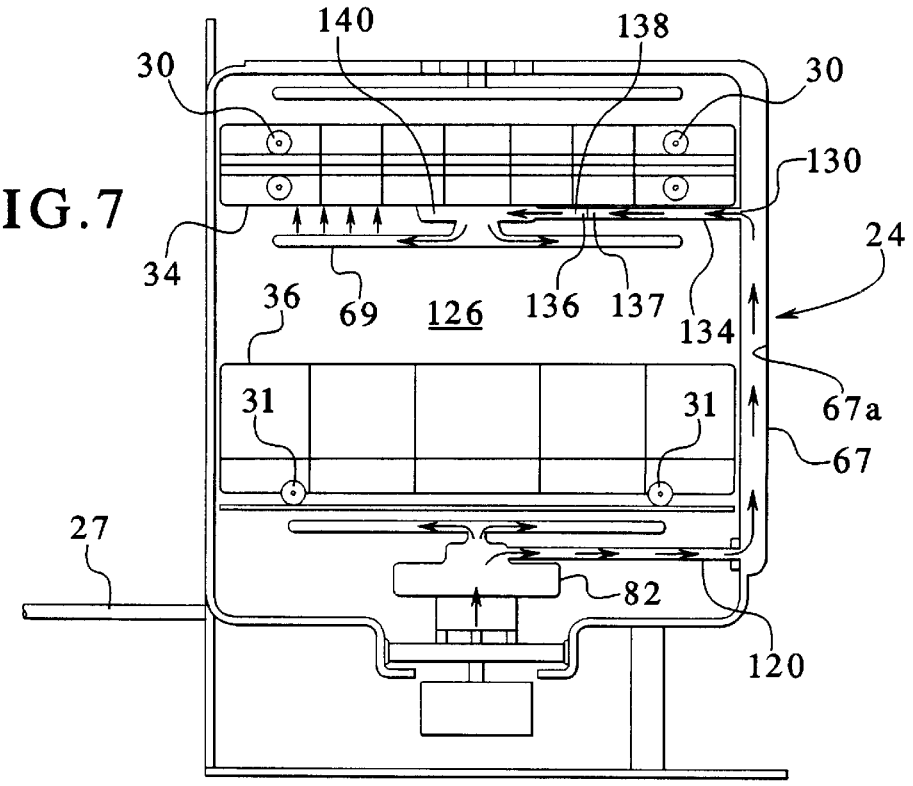
FIG. 7 is a schematic sectional view taken generally along line VII—VII of FIG. 6.

To feed water to the rack mounted top arm 69, as shown in FIG. 7, a wash water conduit 120 extends rearwardly from the dishwasher pump 82 within the dishwasher compartment 126. The conduit is flow connected to an inside of the rear wall vertical rib 67 through first aperture 128 in rear wall 24. Near a top of the rib 67 is a second aperture 130 which is flow connected to an air supply conduit 134 inside the compartment 126. The supply conduit 134 terminates in an open end 136. The open end 136 flow connects with an open end 137 of a nozzle or pipe 138 connected to a hub 140 which is flow connected to the rack mounted spray arm 69. The spray arm 69, hub 140 and nozzle 138 are carried by the rack 34 to extend and retract therewith. When the rack 34 is fully retracted inside the dishwasher, the nozzle 138 and the supply conduit 134 register to complete a flow path between the pump 82 and the spray arm 69. In lieu of the open end 136 meeting open end 137, a more sealed connection can be made if necessary with a snap together connection, or a flexible seal engagement. On the other hand, if a sealed connection is not necessary a jet spray flow connection can be made wherein water passes through the open end 136 at great velocity and jets across an air gap to supply water to the hub 140.

Figure 5:
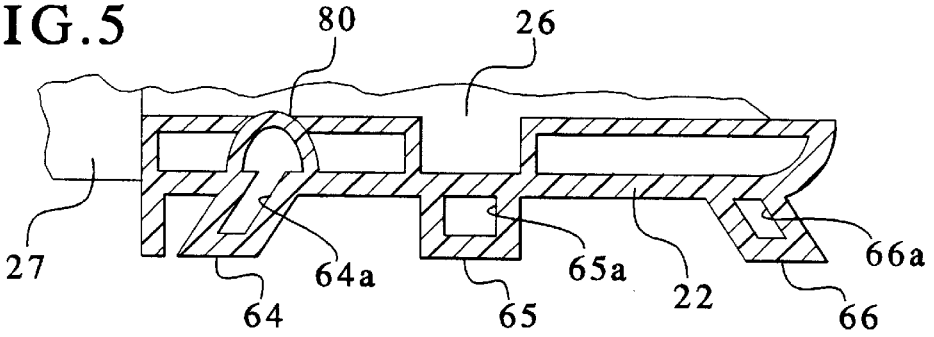
FIG. 5 is a sectional view taken generally along line V—V of FIG. 1.
Figure 6:
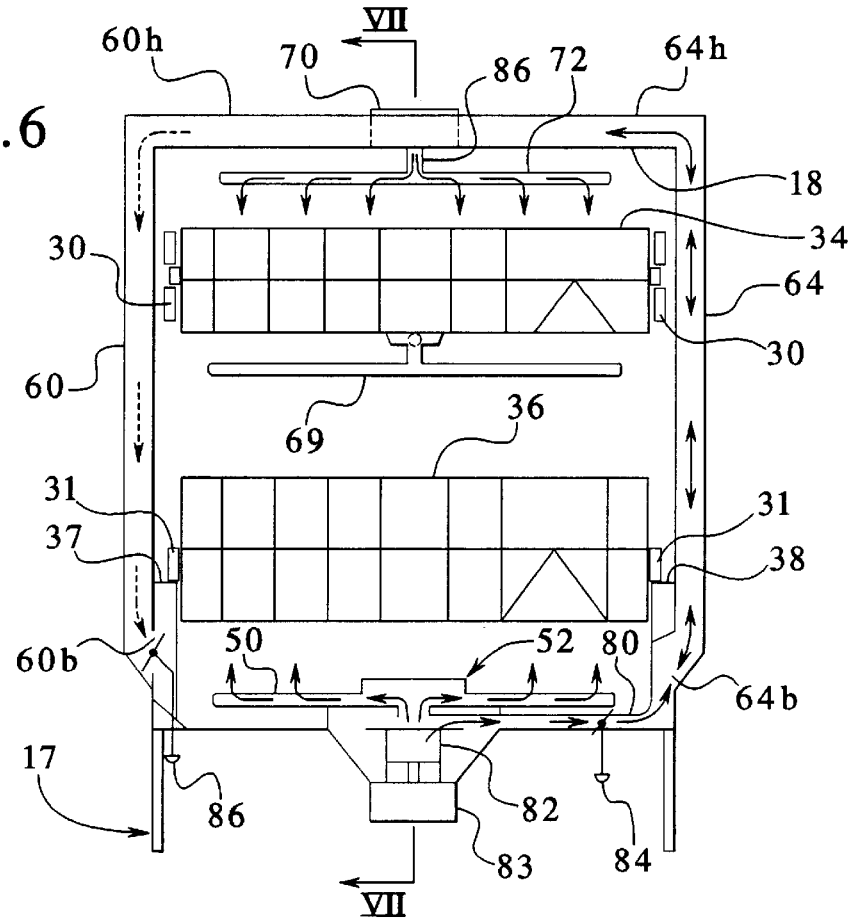
FIG. 6 is a schematic front view of the dishwasher shown in FIG. 1.

To feed water to the top mounted wash arm 72, at least one of the vertical ribs requires an opening connected to a pump outlet as shown in FIGS. 5 and 6. The upper wash arm 72, which can be rotatable, receives water for example through the one rib 64 via a formed channel 64*a* therein and dispenses the water through the upper wash arm 72.

Figure 4:
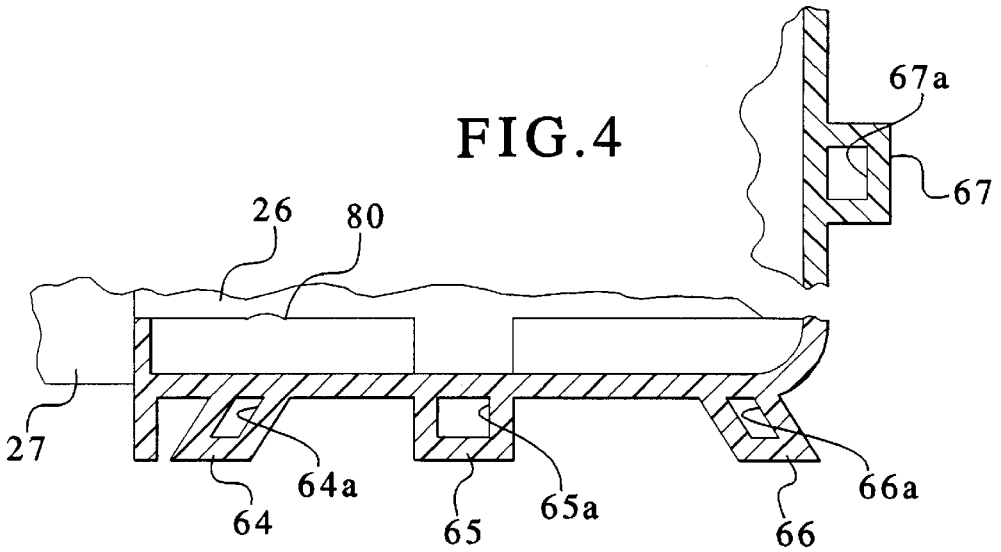
FIG. 4 is a sectional view taken generally along line IV—IV of FIG. 2.

As can be seen from FIGS. 2, 3 and 4, the ribs 60, 61, 62, 63, 64, 65, 66 can be sized to overlie a significant width of the side walls 20, 22 and top wall 18 and thus help reduce heat loss through the side walls due to the insulating effect of a hollow member.

As shown in FIG. 4 the ribs 64, 65, 66, 67 are formed as hollow members integrally with the sidewall 22 by gas injection molding. The ribs 60, 61, 62 on sidewall 20 can be formed identically to the ribs 64, 65, 66. The ribs 64, 65, 66 have central channels 64*a*, 65*a*, 66*a* formed by injecting an amount of plastic into the mold for the sidewall and then injecting gas to form the channels 64*a*, 65*a*, 66*a*. The rear wall rib 67 has a central channel 67*a*. Examples of gas injection molding methods are disclosed in U.S. Pat. Nos. 5,401,459; 5,047,183; 4,101,617; 4,855,094; 5,069,859; and 5,114,660, herein incorporated by reference.

FIG. 5 illustrates that the rib 64 has the channel 64*a* connected by an aperture 64*b* to a conduit 80. The conduit 80 is flow connected to an outlet of a water wash pump 82 of the assembly 52. The wash water pump 82 also provides water to the lower arm 50. The conduit 80 can have a low profile and be located inside the tub; or can be located beneath the floor 26 to maximize inside volume of the tub.

As shown in FIG. 6 the channel 64*a* extends up the sidewall 22, over the top 18 and flow connects to the hub 70. The hub 70 mounts the upper spray arm 72 for rotation, and supplies wash water thereto through a hollow spindle 86. It is anticipated that more than one rib can be used to deliver wash water to the hub 70 by providing an appropriately branched conduit 80 and flow connections to the other ribs. Additionally, one or all of the ribs 60, 61, 62, 64, 65, 66 can function as a water storage area or reservoir for storing wash water or rinse water during the dish washing operation.

A controllable valve 84 can be provided in the conduit 80 for controllably closing the conduit 80 to trap water in the channel 64*a*. Also, more than one channel can be flow connected together to increase the volume of the reservoir. For example, the channel 60*a* can be flow connected through the hub 70 to the channel 64*a*. Thus, this channel can also fill with water, being closed at a bottom opening 60*b* by a second controllable valve 86. Thus, for example, after a wash cycle and rinse cycle, all the rinse water can be retained in the channels 60*a*, 64*a* by the closure of the valves 84, 86. A filter can be provided at or near the valve housing. Some of the retained water would be back-flushed to clean the filter and then directed to the drain. After the filter is cleaned, the valves 84, 86 would open and the saved rinse water could be reused. It is possible to flow connect all the channels together for a larger reservoir. The use of the reservoir results in a water savings advantage.

Figure 8:
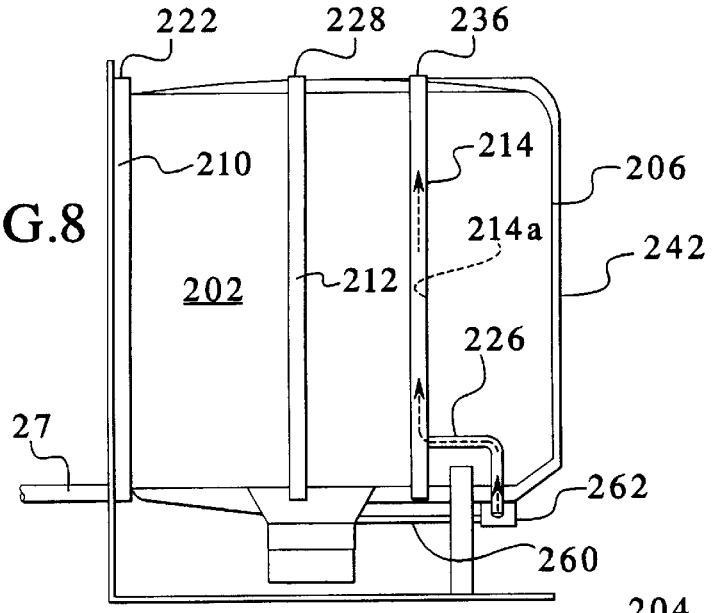
FIG. 8 is a right side view of an alternate arrangement of the dishwasher of FIG. 1.
Figure 9:
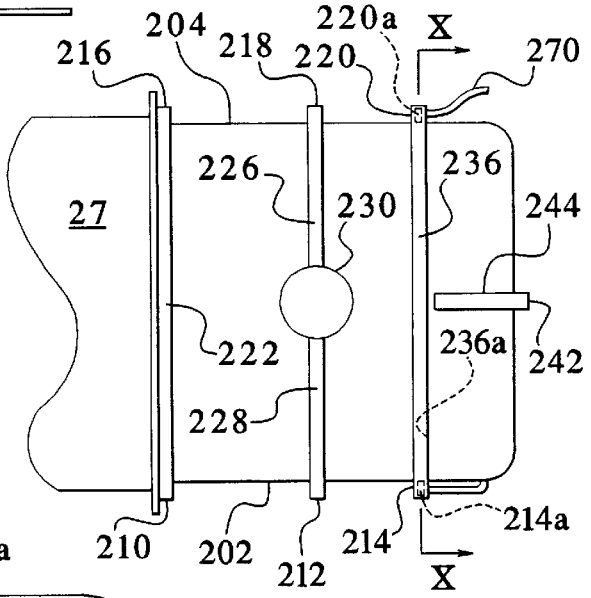
FIG. 9 is a top view of the dishwasher shown in FIG. 8.
Figure 10:
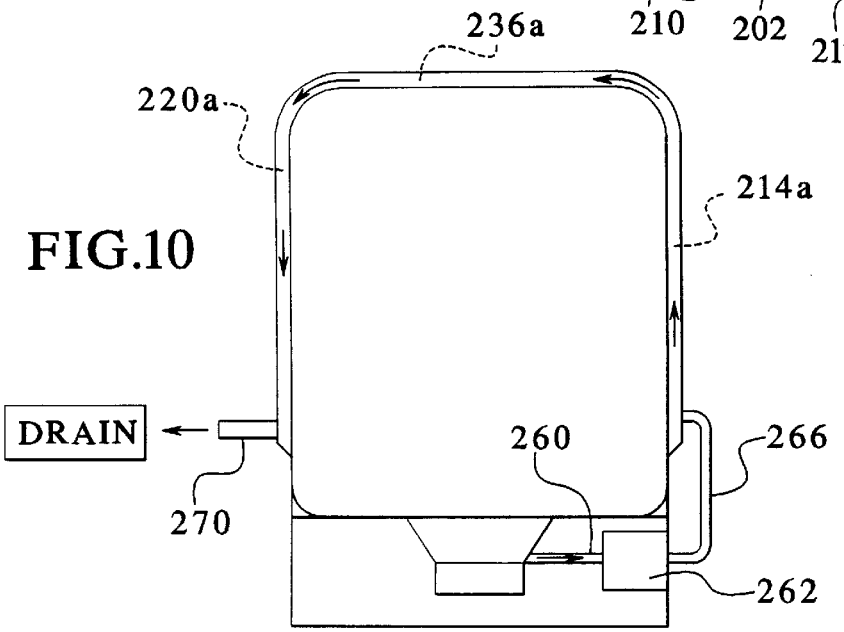
FIG. 10 is a schematic sectional view taken generally along line X—X of FIG. 9.

FIGS. 8–10 describes further aspects of the invention. A tub 200 includes side walls 202, 204 and a back wall 206. Three vertical molded hollow ribs 210, 212, 214 are formed with the first sidewall 202 and the three vertical molded hollow ribs 216, 218, 220 are formed with the second sidewall 204. The ribs 210, 216 are connected continuously by a first horizontal rib 222 formed with a top wall 224. The ribs 212, 218 are connected by second and third horizontal ribs 226, 228 and a top mounted hub 230 all formed with the top wall 224. The ribs 214, 220 are continuously connected by a fourth horizontal rib 236 formed with the top wall 224. A rear wall vertical rib 242 is formed with the rear wall and is connected continuously with a fifth horizontal rib 244 formed with the top wall 224.

The vertical ribs 210, 212, 214, 216, 218, 220 can also be extended downwardly to lower horizontal portions (not shown) which can assist in reinforcing a bottom wall of the tub 220.

FIG. 8 shows the dishwasher tub flow connected by a drain line 260 to a drain pump 262. According to some drain systems it is desirable to have a pressure head on a discharge side of the drain pump. This is particularly true for systems which sense pressure in a soil accumulator to activate a separate drain pump. When the soil accumulator screen such as disclosed in U.S. Pat. No. 5,165,433 is sufficiently clogged, the pressure in the accumulator increases to above a predetermined limit pressure, which activates a pressure switch to energize a drain pump to drain the accumulator through the drain conduit to drain. When the pressure in the accumulator is lowered below the limit pressure, the drain pump is deenergized. A minimum drain head pressure that is greater than the trip pressure of the pressure switch is required. Otherwise, it is possible that the pressure build up in the accumulator, associated with the clogging of the filter, will be great enough to force the accumulator water content past the drain pump if the head pressure is less than the trip pressure, resulting in all the water being eventually depleted from the dishwasher. Thus it is beneficial that the outlet drain line include a vertical loop to ensure a minimum drain head pressure. The drain pump 262 shown in FIG. 8 discharges drain water through an outlet line 266 to an inside channel 214*a* within the rib 214. Thus the drain water circulates upwardly through the conduit 214*a,* through a conduit 236*a* formed inside rib 236 and down through a conduit 220 formed inside rib 220. The water can then be discharged from a low end of the conduit 220*a* though a discharge tube 270, connected to an aperture through a sidewall of the rib 220.

The embodiment of FIGS. 8–10 uses the ribs 214, 236, 220 as drain flow conduits. However other ribs in this embodiment can be used to form the drain flow path as long as the rib provides an elevation head pressure as previously described, other ribs can be used to deliver water to the rack mounted wash arm or to the top mounted wash arm; or to serve as a water reservoir.

Conversely, the embodiments of FIGS. 1–7 can also incorporate the drain flow conduit arrangement of FIGS. 8–10. Thus, it is encompassed by the present invention to include the drain flow conduits 214*a,* 236*a,* 220*a* of FIG. 8–10; the reservoir conduits 64*a,* 60*a* of FIG. 6; the top mounted spray arm conduits 80, 64*a* and hub 70 of FIG. 6; and the rack mounted spray arm conduits 120, 67*a,* 134, 138 and hub 140 all in one dishwasher, or to provide the features separately or in any combination in a dishwasher.

By using one of the gas injected vertical ribs as a channel for pumped wash water to the upper wash arm, drawbacks of prior art upper wash arm conduits are avoided. The gas injected vertical rib on an outside of the side walls of the present invention is not visible when the dishwasher is installed in kitchen cabinetry. It does not include external water connections so that external water leaks are unlikely. It is not visible inside the cabinet as are inside conduit systems. It also does not require room inside the dish washing area as do "tower" systems. It also does not trap food inside the tub as can upper wash arm delivery tubes.

By forming the vertical and horizontal ribs of the present invention using gas injection plastic molding, hollow integral tubes are formed with the respective wall which carries the rib. The hollow ribs can be effectively utilized as water conduits, or for water storage. The ribs not used for water channeling or containment are still effective for improved structural integrity of the tub and to decrease heat transfer through the sidewalls of the tub. By using gas injection, plastic material usage is reduced and also the walls are kept free of sink marks caused by shrinkage due to uneven thickness of plastic.

Although the present invention has been described with reference to a specific embodiment, those of skill in the art will recognize that changes may be made thereto without departing from the scope and spirit of the invention as set forth in the appended claims.

The embodiments of the invention in which an exclusive property or privilege is claimed are defined as follows:

1. A dishwasher comprising:

a molded plastic tub having a top wall, parallel first and second side walls, a bottom wall and a back wall, the walls of the tub being substantially fluid impervious; and at least one vertical reinforcing rib integrally formed with at least one of said first and second side walls, said reinforcing rib being a hollow member, said at least one reinforcing rib is on said at least one of said first and second side walls and extends continuously into a top wall reinforcing rib portion directed from said at least one of said first and second side walls along said top wall.

2. A dishwasher according to claim 1, further comprising a pump flow connected to a source of water; a wash arm within said tub and having apertures therein; and wherein said at least one reinforcing rib includes a first opening at a bottom thereof through said one of said first and second side walls for receiving water from said pump, and a second opening at a top thereof for delivering water to said wash arm for delivering water through said apertures of said wash arm.

3. A dishwasher according to claim 2, comprising a conduit connected between said pump and an inside of said one of said first and second sidewalls in registry with said first opening.

4. A dishwasher according to claim 2, wherein said second opening is through said top wall, said second opening surrounded by a hub mounted to said top wall, said hub rotationally supporting said wash arm.

5. A dishwasher according to claim 1, wherein said at least one reinforcing rib comprises two reinforcing ribs on each of said first and second side walls, and said four reinforcing ribs extending continuously into top wall reinforcing rib portions directed from said side walls along said top wall toward a center thereof.

6. A dishwasher according to claim 5, wherein said reinforcing ribs comprise a hollow polygon cross section.

7. A dishwasher comprising:

a molded plastic tub having a top wall, parallel first and second side walls, a bottom wall and a back wall;

at least one vertical reinforcing rib integrally formed with at least one of said first and second side walls, said reinforcing rib being a hollow member;

a pump flow connected to a source of water; and a wash arm within said tub and having apertures therein;

wherein said at least one reinforcing rib includes a first opening at a bottom thereof through said one of said first and second side walls for receiving water from said pump, and a second opening at a top thereof for delivering water to said wash arm for delivering water through said apertures of said wash arm.

8. A dishwasher comprising:

a molded plastic tub having opposed top and bottom walls, opposed first and second side walls and a back wall connected to the top wall, bottom wall, and first and second side walls;

at least one hollow reinforcing rib integrally formed with at least one of the top wall, bottom wall, back wall, and first and second side walls;

a door mounted to the tub;

a dish rack inside the tub;

a spray arm inside the tub; and a pump fluidly connected to the spray arm and to the inside of the tub.

9. A dishwasher according to claim 8, wherein the hollow reinforcing rib is fluidly connected to the pump.

10. A dishwasher accordingly to claim 9, wherein the hollow reinforcing rib is fluidly connected to the spray arm.

* * * * *